US006845816B2

(12) United States Patent
Kirk et al.

(10) Patent No.: US 6,845,816 B2
(45) Date of Patent: Jan. 25, 2005

(54) ADI CENTRALIZER

(75) Inventors: Ian Alastair Kirk, Aberdeen (GB); William Barron, Aberdeen (GB); Allstair Bertram Clark, Aberdeen (GB); Arron Rimmer, West Midlands (GB); Barry Newton, Oxon (GB)

(73) Assignee: Downhole Products, PLC, Aberdeen (GB)

( * ) Notice: Subject to any disclaimer, the term of this patent is extended or adjusted under 35 U.S.C. 154(b) by 27 days.

(21) Appl. No.: 09/803,191

(22) Filed: Mar. 9, 2001

(65) Prior Publication Data

US 2001/0035291 A1 Nov. 1, 2001

(30) Foreign Application Priority Data

Mar. 10, 2000 (GB) ..... 0005740

(51) Int. Cl.[7] ..... E21B 17/10

(52) U.S. Cl. ..... 166/241.6; 166/241.1; 175/325.1; 175/325.5

(58) Field of Search ..... 166/241.1, 241.2, 166/241.4, 241.6, 241.5, 241.7; 175/325.1, 325.2, 325.5, 325.6, 325.7

(56) References Cited

U.S. PATENT DOCUMENTS

| | | | | | |
|---|---|---|---|---|---|
| 1,807,050 | A | * | 5/1931 | Stolz | 166/285 |
| 2,166,116 | A | * | 7/1939 | Bettis | 166/241.6 |
| 3,692,109 | A | * | 9/1972 | Grayson | 166/241.1 |
| 4,081,203 | A | * | 3/1978 | Fuller | 175/325.4 |
| 4,088,185 | A | | 5/1978 | Carson | |
| 4,664,206 | A | | 5/1987 | Butler | |
| 4,913,230 | A | * | 4/1990 | Rivas et al. | 166/241.3 |
| 5,031,709 | A | * | 7/1991 | Fischer | 175/325.5 |
| 5,095,981 | A | | 3/1992 | Mikolajczyk | |
| 5,334,268 | A | * | 8/1994 | Hermanson et al. | 148/530 |
| 5,853,199 | A | * | 12/1998 | Wilson | 285/45 |
| 5,937,948 | A | | 8/1999 | Robbins, III | |
| 6,039,127 | A | * | 3/2000 | Myers | 175/57 |
| 6,250,180 | B1 | * | 6/2001 | Legner et al. | 74/733.1 |

FOREIGN PATENT DOCUMENTS

EP 0064730 A2 11/1982

OTHER PUBLICATIONS

American Society for Metals, *ASM Metals Handbook: Properties and Selection; Irons, Steels, and High Performance Alloys*, 10$^{th}$ ed., vol. 1 (ASM, Apr. 1990), contents page, p. 42.

American Society for Metals, *ASM Specialty Handbook: Cast Irons* (ASM, 1996), contents page, pp. 197–199.

* cited by examiner

*Primary Examiner*—Hoang Dang
(74) *Attorney, Agent, or Firm*—Blackwell Sanders Peper Martin LLP

(57) ABSTRACT

A centralizer for use in centralizing casing or other tubulars such as tubulars in an oil or gas well comprising an annular body with a bore extending through the body and one or more blades, the centralizer being adapted to fit around a tubular to be centralized, and comprising a tempered metal such as austemperized ductile iron (ADI).

6 Claims, 4 Drawing Sheets

ADI CENTRALIZER

APPLICATION CROSS-REFERENCE

This application claims priority of Great Britain Patent No. 0005740.6, filed Mar. 10, 2000.

FIELD OF THE INVENTION

This invention relates to a centralizer, and particularly to a centralizer for use in centralizing casing or other tubulars such as drillpipe or screens in an oil or gas well.

BACKGROUND OF THE INVENTION

In drilling wellbores for oil and gas it is common to drill through the formation and subsequently to case the open bore with a liner or a casing (typically of metal) and to cement the liner or casing in place. Centralizers are used around the liner or casing in order to keep it in the middle of the borehole and to allow free flow of cement through the annulus between the casing and the wall of the borehole. This acts as a sealant and also as a mechanical support for the casing. Centralizers have therefore been adapted for attachment around the outer diameter of a liner or casing prior to the cement job. Centralizers can also be used to keep a screen in a central location in the wellbore as it passes through a formation.

SUMMARY OF THE INVENTION

According to the present invention there is provided a centralizer comprising an annular body with a bore extending through the body and one or more blades, the centralizer being adapted to fit around a tubular to be centralized, and comprising a tempered metal.

The invention also provides a method of manufacturing a centralizer, the method comprising forming the centralizer from metal and tempering the metal centralizer.

The metal is preferably austenitized, typically by heating the metal to 800–960° C. typically for 1 to 4 hours. Preferably the metal is also austempered by quenching in molten salt for 2–4 hours at 200–400° C. and preferably air dried. Preferably the salt is a mixture of potassium nitrate and sodium nitrite. Typically an equimolar mixture of these salts is used. Typically the entire centralizer is formed from the tempered metal. Any other tempering process can be used to temper the metal. Suitable methods can be found in Metals Handbook Vol. 1–3 1990–1991 published by ASM International.

The metal is preferably ductile metal and most preferably comprises ductile iron, although any metal that can be tempered will suffice. Castable metals are preferred.

Alloys can be used as the metal of the centralizer, and in particular, iron can be alloyed with Mo, Cu or Ni to enhance the hardness of the metal.

The iron is normally a cast iron with preferably 3.2–3.8% C (most preferably around 3.6% C) and 2.2–2.8% Si (most preferably around 2.5%). Typically other alloying elements are added in very small quantities (<0.04%) which may include Mg, Mn, Cu, Ni, Mo, Sn, Sb, P, S, O, Cr, Ti, V, Al, As, Bi, B, Cd, Pb, Se, Te. Elements such as Be, Ca, Sr, Ba, Y, La, Ce may be added in lieu of, or in addition to, Mg.

Grades 1–5 of ADI are preferred according to ASTM 897M-90.

The centralizer is typically cast into the desired shape with the annular body and blades, optionally shaped e.g. by filing or grinding, and then tempered, e.g. by austempering the whole centralizer. The tempering process can be extended in accordance with the ratio of ferrite:pearlite in the metal. Metals with a higher ferrite:pearlite ratio may need longer tempering process times. The centralizer is typically cast in a slightly different shape (e.g. with an oval-shaped annular body) to that of the final product (e.g. a cylindrical annular body) to allow for distortions occurring during the casting and tempering process. Typically the centralizer shrinks by e.g. 1–2% during casting and typically expands by e.g. 1–2% after heat treatment. Therefore the centralizer is typically cast to a different size than finally required.

The blades are preferably circumferentially distributed around the outer surface of the centralizer, and preferably each extends parallel to the bore of the centralizer. The blades are preferably disposed opposite one another on the centralizer body. There may be four, five or six such blades or some other number.

The method of the invention is typically carried out by high-temperature casting in a sand casting mold. The blades of the centralizer are typically formed between indentations in the mold and protrusions on a blank set in the mold. The blade shapes are typically profiled to facilitate removal of the cast centralizer from the mold, and are typically profiled differently from one another. The centralizer is typically formed by two half-molds adapted to engage one another so as to form the centralizer between the two half-molds. Typically the join between the two molds is aligned with a blade of the centralizer.

The tubular can be drillpipe, casing, liner, production tubing, coil tubing and may include slotted and predrilled and/or plugged tubing, screens and perforating strings etc for disposal in the reservoir payzone, in which case the centralizer would maintain the screen in the middle of the uncased borehole.

BRIEF DESCRIPTION OF THE DRAWINGS

Reference is now made more particularly to the drawings which illustrate the best presently known mode of carrying out the invention and wherein similar reference characters indicate the same parts throughout the views.

DETAILED DESCRIPTION

Figure 1:
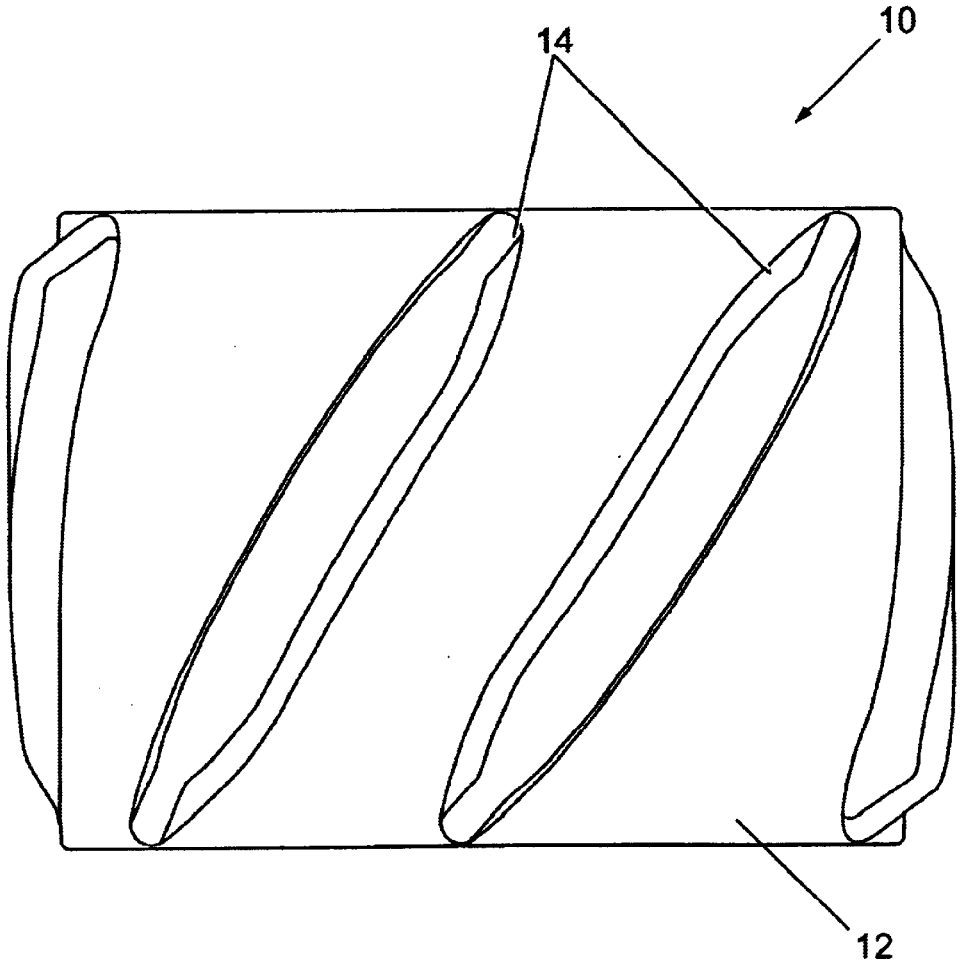
FIG. 1 is a front elevation of a centralizer.
Figure 2:
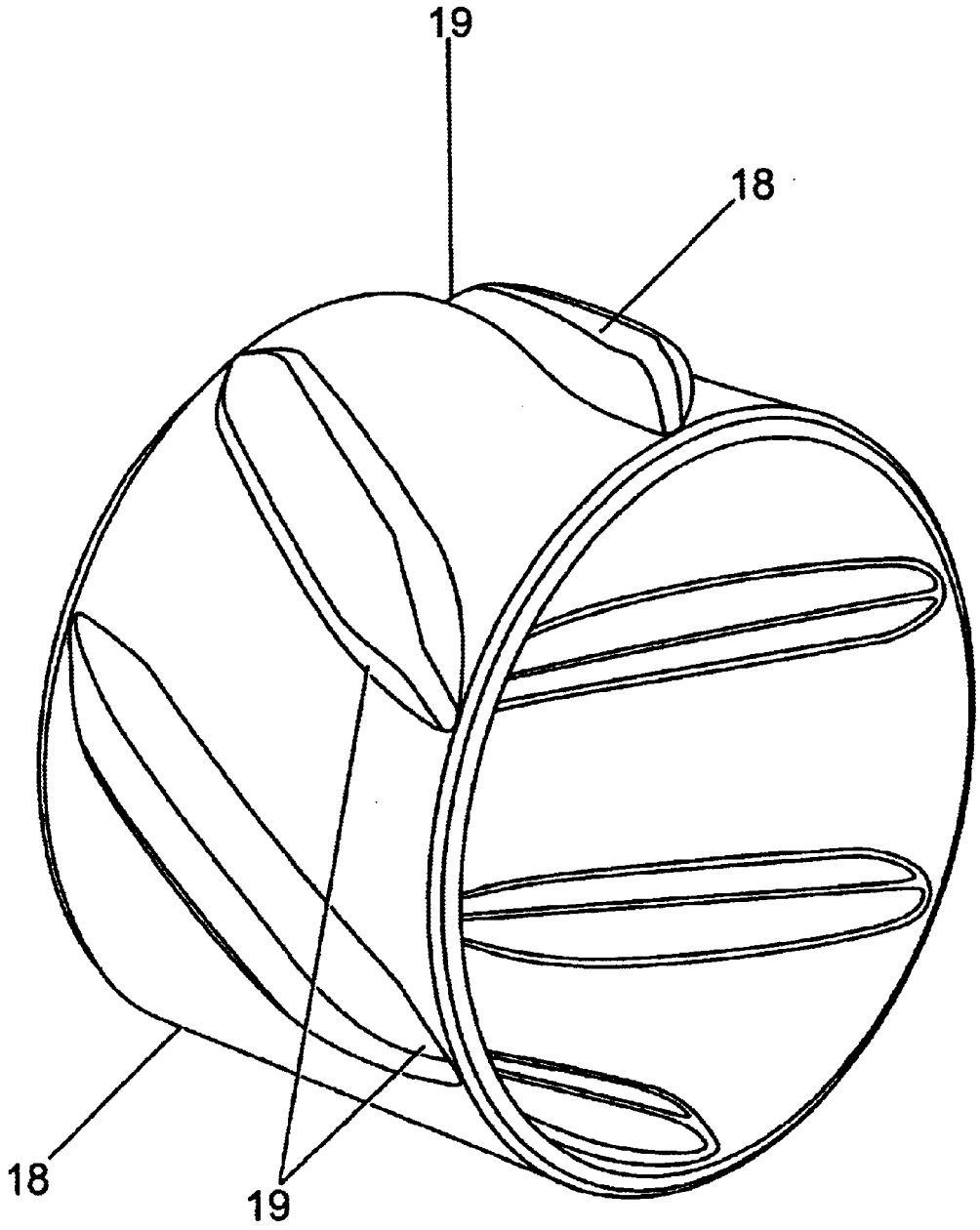
FIG. 2 is a side perspective view of the FIG. 1 centralizer.
Figure 3:
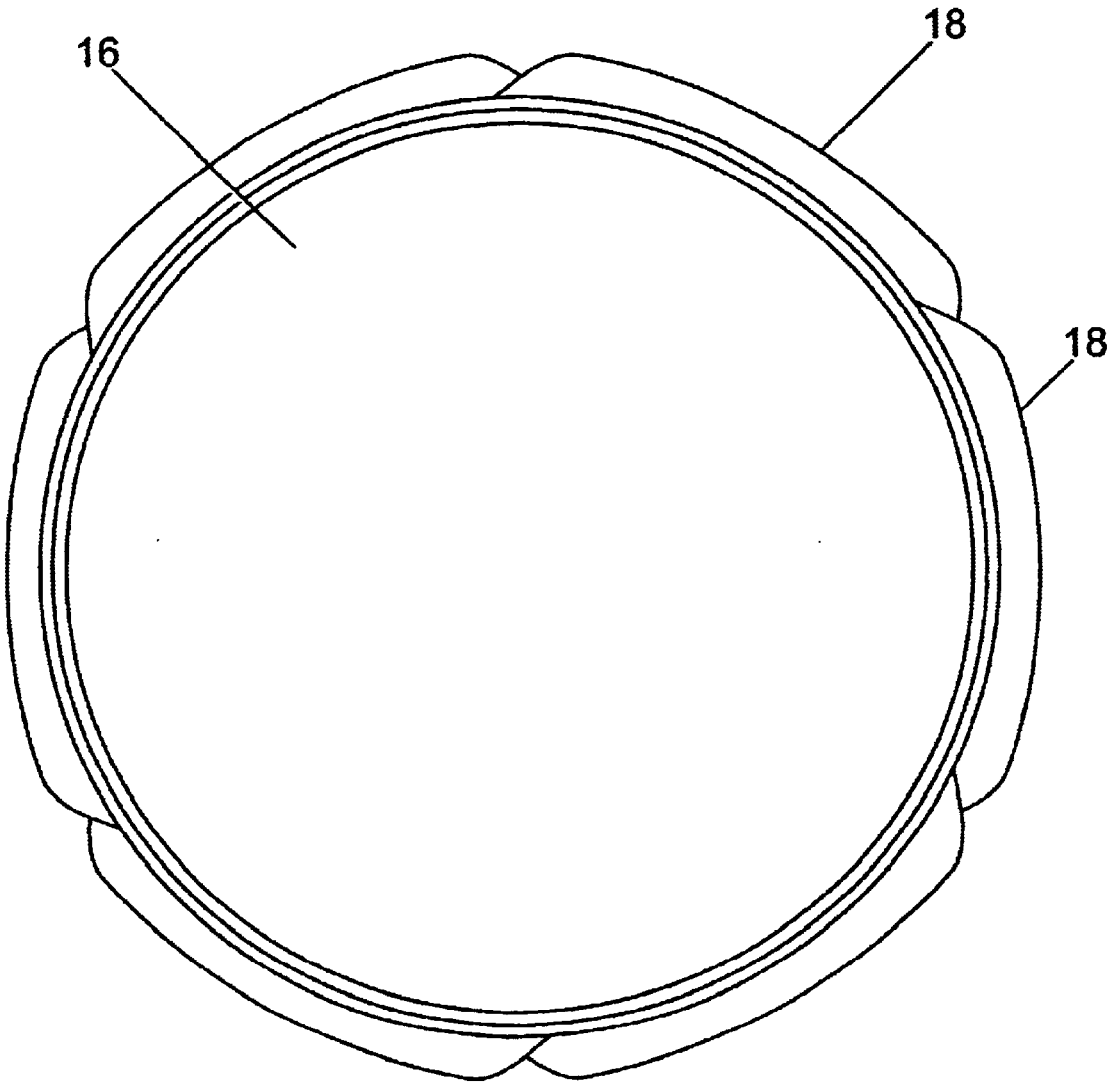
FIG. 3 is a plan view of the FIG. 1 centralizer.
Figure 4:
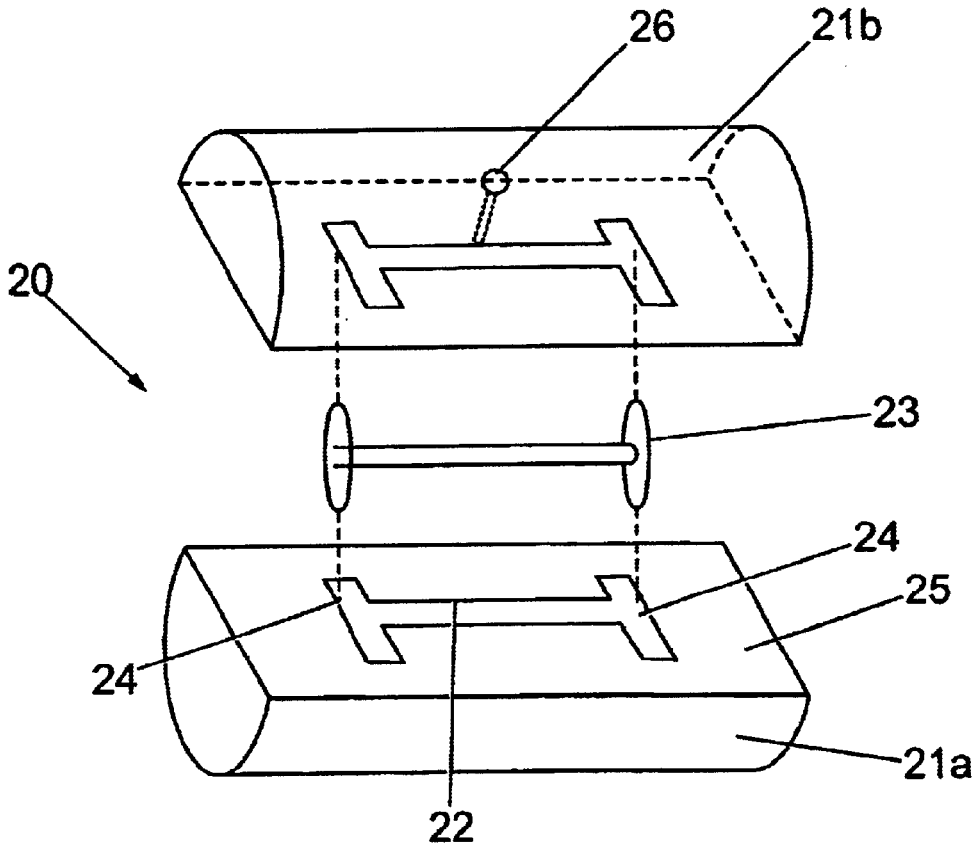
FIG. 4 is a perspective exploded view of a sand cast used to manufacture the FIG. 1 centralizer.

A casing centralizer 10 comprises a unitary molded cylindrical body 12, and an array of six equiangularly-spaced blades 14 integrally formed with the body 12. A cylindrical bore 16 extends axially through the body 12, and has a substantially uniform diameter dimensioned to be a clearance fit around the well bore casing, or other tubular to which the centralizer is applied.

Each of the blades 14 not only extends between longitudinally opposite ends of the body 12, but also extends circumferentially around the periphery of the centralizer 10. The skewing of the blades 14 ensures that their respective outer edges 18 collectively provide a generally uniform well bore-contacting surface around the circumference of the centralizer 10.

Each of the blades 14 has a respective radially inner root 19 integral with the body 12. In each of the blades 14, the root 19 has a greater circumferential width than the outer edge 18, i.e. the cross-section of each blade 14 tapers towards the well bore-contacting periphery of the centralizer 10. The individual and collective shapes of the blades 14, and of the longitudinal fluid flow passages defined between adjacent pairs of the blades 14, gives the centralizer 10 improved flow characteristics and minimizes the build-up of trapped solids during use of the centralizer 10. The tapered cross-section of the blades also eases removal of the centralizer from the cast during manufacture.

Longitudinally opposite ends of the blades 14 and of the body 12 are chamfered to assist in movement of the centralizer 10 up/down a well bore.

The blades 14 of the centralizer 10 keep the tubular centralized within the borehole, and bear against the wall of the borehole to reduce friction should the tubular be moved.

It is preferred that the entire centralizer 10 be fabricated as a one-piece article (although the blades 14 could be separately formed and subsequently attached to the body 12 by any suitable means). The centralizer 10 is typically formed from ductile iron and molded in a sand cast 20.

The sand cast 20 is used to cast mold the centralizer 10. The sand cast 20 is made up from two parts 21*a*, 21*b* with semi-circular cross section.

An indent 22 to correspond to the outer face of the centralizer 10 is first cut out from the sand 25 in each part 21*a*, 21*b* of the cast 20. Further indentations are then cut into the indent 22 to form outer faces of blades 14 in the cast centralizer. An inner core 23 is secured in support holes 24 to act as a blank and is suspended in the indent 22 without touching the walls thereof so as to displace metal from an axial bore of the centralizer 10 and provide on its outer surface a blank for the inner surface of the centralizer 10. The core 23 is therefore located in the mold where the bore 16 of the centralizer will be in the finished article. The upper cast 21*b* is joined to the lower cast 21 a before the metal is poured so that the complete shape cut out of the sand 25 is that of the centralizer 10. Normally the join between the upper 21*b* and lower 21*a* parts of the cast are aligned with or are close to a blade 14.

As the material will shrink on cooling and its dimensions will be altered during heat treatment, the shape of the indent 22 can first be precisely determined from shrinkage calculations and by measurements of previous casts. The material being molded will also affect the shrinkage characteristics. Typically the centralizer will expand during the tempering process. As the shrinkage after casting and particularly the expansion after tempering, is non-uniform a specifically calculated indent 22 is used to make the centralizer 10. We find that ductile iron shrinks by about 1–2% when cooling in the cast, and expands by about 1–2% when being tempered.

The sides of the indent 22 curve inwards to allow the mold to be removed from the centralizer after the material has solidified. The blades 14 are tapered to ease the removal of the centralizer 10 from the mold.

Molten ductile iron is poured through the hole 26 and into the indent 22. The iron is allowed to cool and so the centralizer 10 is formed. The sand cast 20 can then be removed from the centralizer 10. The tapered sides of the indent 22 and tapered blades 14 allow the cast to be removed relatively easily.

The iron is normally a cast iron with between 3.2–3.8% C (most preferably around 3.6% C) and 2.2–2.8% Si (most preferably around 2.5%). C and Si to an extent, encourage similar properties in the material and so the sum of % C, and (⅓) % Si can be considered as a carbon equivalent(CE). The total CE ranges are typically around 4.3% for thick sections (over 2"), to 4.6% for thin sections, (0.1"–0.5"), but other values can be used.

Optionally other alloying elements are added in very small quantities which may include Mn(typically 0.35–0.60%), Mg ((% S×0.76)+0.025%+/−0.005%), Sn 0.02+/−0.003%), Sb (0.002%+/−0.0003%), P (0.04%), S (0.02%), O (50 ppm), Cr (0.10%), Ti(0.040%), V (0.10%), Al (0.050%), As (0.020%), Bi (0.002%), B (0.002%), Cd (0.005%), Pb (0.002%), Se (0.030%), and/or Te (0.020%).

To increase hardenability for a heavier section (i.e. greater than 19 mm), Cu(up to 0.8%), Ni(up to 2%) and Mo(up to 0.3%) may be added. Increased hardenability helps to prevent the formation of pearlite during quenching. Mg is added to encourage nodulization. Elements such as Be, Ca, Sr, Ba, Y, La, Ce may be added in lieu of or in addition to Mg. The total weight of nodulizing elements is not normally more than about 0.06%.

The castings should be free of non-metallic inclusions, carbides, shrink and dross. Proper purchasing, storage and use of charge material will minimize the unwanted occurrence of carbides and gas defects. Proper molding control will minimize surface defects and other sub-surface discontinuities. The casting should be properly gated and poured using consistent and effective treatment and inoculation techniques to ensure shrink free castings. Preferably the nodule count will be at least 100/mm$^2$ and the nodularity at least 85%.

After casting the centralizer 10 is tempered by a heat treatment to produce a stronger, harder material. The ductile iron used to produce the centralizer 10, normally contains pearlite and ferrite which are irregular in shape and vary substantially in size. This reduces hardness and strength. The centralizer is heated to the austenite phase i.e. between 815° C. and 955° C. depending on the precise concentration of the alloys. The centralizer is held for 1–4 hours in the austenite phase, the precise time required depends on the size of the centralizer and the amount of ferrite in the metal; a higher concentration of ferrite may require more time at these elevated temperatures. When the austenite is saturated with carbon the centralizer is then austemperized. To achieve this the metal is quenched in molten salt at 240° C.–400° C. The rate of cooling should be sufficient to avoid the formation of ferrite or pearlite. The metal is held in the salt for 1–4 h to allow the austenite to change to ausferrite. The molten salt is normally an equimolar mixture of potassium nitrate/sodium nitrite although other salts may be used.

The net effect of the heat treatment is to cause the ferrite and pearlite phases to be converted into ausferrite. Ausferrite is a stabilized carbon enriched austenite and acicular ferrite non-equilibrium phase. The resulting material is termed austemperized ductile iron (ADI).

This material is twice as strong as conventional ductile iron. Another advantage is that this material is less dense than conventional steel and so is up to 10% lighter. A further advantage is the increased hardenability compared with steel. The cost of manufacturing in this way is also reduced.

Alternatively, other heat treatments may be used to adapt the microstructure and phase composition of the metal 22.

For example to increase ductility the material may be heated up to 700–730° C. After 1–4 hours the material is quenched in molten salt. This reduces the amount of coarse pearlite and increases the amount of spheriodite in the structure.

A further alternative may be to anneal the steel. The centralizer is again heated into the austenite phase but is then allowed to cool gradually. This produces a microstructure with small and uniform grains.

Modifications and improvements can be incorporated without departing from the scope of the invention.

What is claimed is:

1. A centralizer comprising an annular body with a bore extending through the body and one or more blades, the centralizer being adapted to fit around a tubular to be centralized, and being made substantially from a tempered metal comprising austemperized ductile iron.

2. The centralizer as claimed in claim 1, wherein the centralizer is adapted to fit around a casing to be centralized within a bore hole.

3. The centralizer as claimed in claim 1, wherein the metal comprises at least one of 3.2–3.8 wt % C and 2.2–2.8 wt % Si.

4. The centralizer as claimed in claim 1, wherein the metal is alloyed with at least one of Mo, Cu and Ni.

5. The centralizer as claimed in claim 1, wherein the metal is alloyed with at least one of Mg, Mn, Sn, Sb, P, S, O, Cr, Ti, V, Al, As, Bi, B, Cd, Pb, Se, Te, Be, Ca, Sr, Ba, Y, La, and Ce.

6. The centralizer as claimed in claim 1, wherein the blades are circumferentially distributed around the outer surface of the centralizer, each extending parallel to the bore of the centralizer.

* * * * *